United States Patent [19]

Mroz

[11] Patent Number: 4,890,731

[45] Date of Patent: Jan. 2, 1990

[54] PERSONAL SPORTS EQUIPMENT CARRIER

[76] Inventor: Edward J. Mroz, 139 4th St., Oakmont, Pa. 15139

[21] Appl. No.: 294,272

[22] Filed: Jan. 6, 1989

[51] Int. Cl.[4] ..... B65D 85/00

[52] U.S. Cl. ..... 206/315.9; 206/315.1; 206/579; 294/143; 294/146; 294/159; 294/161; 273/74; 220/4 E

[58] Field of Search ..... 206/315.1, 315.9, 579; 273/74; 294/143, 145, 146, 159, 161; 220/4 B, 4 E

[56] References Cited

U.S. PATENT DOCUMENTS

| | | | |
|---|---|---|---|
| 1,203,095 | 10/1916 | Bristow . | |
| 1,318,007 | 10/1919 | Gau | 220/4 E |
| 2,889,863 | 6/1959 | Arnold, Jr. | 150/1.5 |
| 2,987,109 | 6/1961 | Sohmer | 294/159 |
| 2,990,865 | 7/1961 | Steele | 294/146 |
| 3,215,181 | 11/1965 | Reed | 294/146 |
| 3,483,996 | 12/1969 | Scammon | 294/143 |
| 3,830,362 | 8/1974 | Tassone et al. | 206/223 |
| 3,848,739 | 11/1974 | Kenon | 206/315.9 |
| 3,933,241 | 1/1976 | Tassone et al. | 206/223 |
| 3,977,521 | 8/1976 | Murphy | 206/315 |
| 4,036,416 | 7/1977 | Lowe | 294/143 |
| 4,049,126 | 9/1977 | Halverson | 294/159 |
| 4,179,054 | 12/1979 | Bredehoeft et al. | 273/74 |
| 4,193,495 | 3/1980 | Keeley | 294/143 |
| 4,344,660 | 8/1982 | Molnar et al. | 312/250 |
| 4,526,414 | 7/1985 | Jones | 294/146 |
| 4,595,226 | 6/1986 | Wessel | 294/146 |
| 4,629,065 | 12/1986 | Braaten | 206/315.1 |
| 4,666,038 | 5/1987 | Minneman | 294/146 |
| 4,693,402 | 9/1987 | Comeau | 224/215 |

*Primary Examiner*—David T. Fidei

*Attorney, Agent, or Firm*—Stanley J. Price, Jr.

[57] ABSTRACT

A personal sports equipment carrier adapted for carrying baseball or softball equipment is provided. The sports equipment carrier has a rigid frame with recesses formed in it to receive bats. Balls may be positioned in the bottom of the rigid frame and are held in place by straps that are fastened longitudinally onto the frame at a distance above the bottom of the frame approximately equal to the radius of the balls to be retained. An eyelet or a velcro strip is provided to receive the strap of a baseball glove and the tied-together laces of shoes. A handle is secured to the rigid frame so that a baseball or softball player may carry his own equipment conveniently. Storage eyelets may also be secured to the frame so that the frame and the equipment therein may be stored by passing the eyelets over hooks or nails that protrude from a wall or the like.

17 Claims, 2 Drawing Sheets

PERSONAL SPORTS EQUIPMENT CARRIER

BACKGROUND OF THE INVENTION

1. Field of the Invention

This invention relates to a personal sports equipment carrier for carrying the baseball or softball equipment of a single player. The equipment carrier conveniently carries bats, balls, a glove and shoes of a baseball or softball player.

2. Description of the Prior Art

The problem of transporting baseball and softball equipment, bats, balls, gloves, and shoes has existed for as long as the games have been played. There are many examples of equipment carriers which are utilized to carry equipment for a whole team. U.S. Pat. Nos. 2,889,863, 3,977,521, and 4,344,660 are all examples of equipment carriers wherein equipment for an entire team is placed in a carrier for movement to and from the field of play. Similarly, U.S. Pat. No. 4,629,065 discloses a baseball equipment holder which permits the equipment of a team to be positioned for availability during a game.

There are, in the prior art, patents which disclose equipment carriers to be carried by one person such as U.S. Pat. Nos. 1,203,095 and 4,693,402. There is also prior art which discloses packaging arrangements for baseball bats and balls. U.S. Pat. Nos. 3,830,362 and 3,933,241 are examples of these packaging arrangements.

None of the foregoing patents discloses a rigid personal sports equipment carrier which may retain bats, balls, a glove and shoes in an orderly fashion so that the ball player may store his equipment and carry it to the game. The sports equipment carrier of the present invention is particularly useful for young players who may be playing in Little Leagues, or the like, where they carry their own equipment to the games.

SUMMARY OF THE INVENTION

In accordance with the present invention, there is provided a personal sports equipment carrier adapted for carrying baseball or softball equipment of an individual player which includes a rigid, rectangular frame that has recesses formed in the frame to receive one or more bats positioned longitudinally relative to the frame and extending beyond the ends of the frame. There are means provided to maintain the bats within the frame while transporting the frame and the bats. There are also means provided to retain one or more balls in the bottom of the frame while transporting the frame. A handle is attached to the frame to enable the player to carry the frame.

Further in accordance with the present invention, there is provided a personal sports equipment carrier adapted for carrying baseball or softball equipment of an individual player which includes a rigid, rectangular frame that has a first frame member and a second frame member. Hinge means are provided to connect the first and second frame members whereby the frame members may be pivotally moved between open and closed positions relative to each other. Semicircular recesses are formed in the first and second frame members so that when the first and second frame members are pivoted to the closed position, the semicircular recesses register with each other to form full circular openings in the frame. The full circular openings are of such size that a large circular opening in one end of the frame receives the heavy end of the bat and a small circular opening in the other end of the frame that is axially aligned with the large circular opening receives the handle of the same bat. Latches are fixed to the first and second frame members for selectively latching the frame members in the closed position. Ball retaining means are provided to retain balls in the bottom of the frame while transporting the frame. A handle is attached to the first frame member to enable the player to carry the frame and the sports equipment that is in it.

In the personal sports equipment carrier of the present invention, the bats are positioned within a rigid frame and are held separated from one another in an orderly fashion which protects the bats and makes them easier to carry. The balls are retained within the rigid frame structure and the baseball glove and shoes are secured to the frame structure by means of an eyelet or by means of a velcro strap through which the strap on the baseball glove passes. The entire package may be readily carried by the ball player.

Accordingly, the principal object of the present invention is to provide a personal sports equipment carrier adapted for carrying baseball or softball equipment of an individual player in an orderly fashion which protects the equipment.

Another object of the present invention is to provide a personal sports equipment carrier having a rigid frame which holds the baseball and softball equipment of an individual player for ready transportation of the equipment.

A further object of the present invention is to provide a personal sports equipment carrier for carrying baseball or softball equipment of an individual player that may be readily stored when not in use to hold the equipment of the player in an orderly fashion when not in use.

These and other objects of the present invention will be more completely disclosed and described in the following specification, the accompanying drawings, and the appended claims.

DESCRIPTION OF THE PREFERRED EMBODIMENTS

Figure 1:
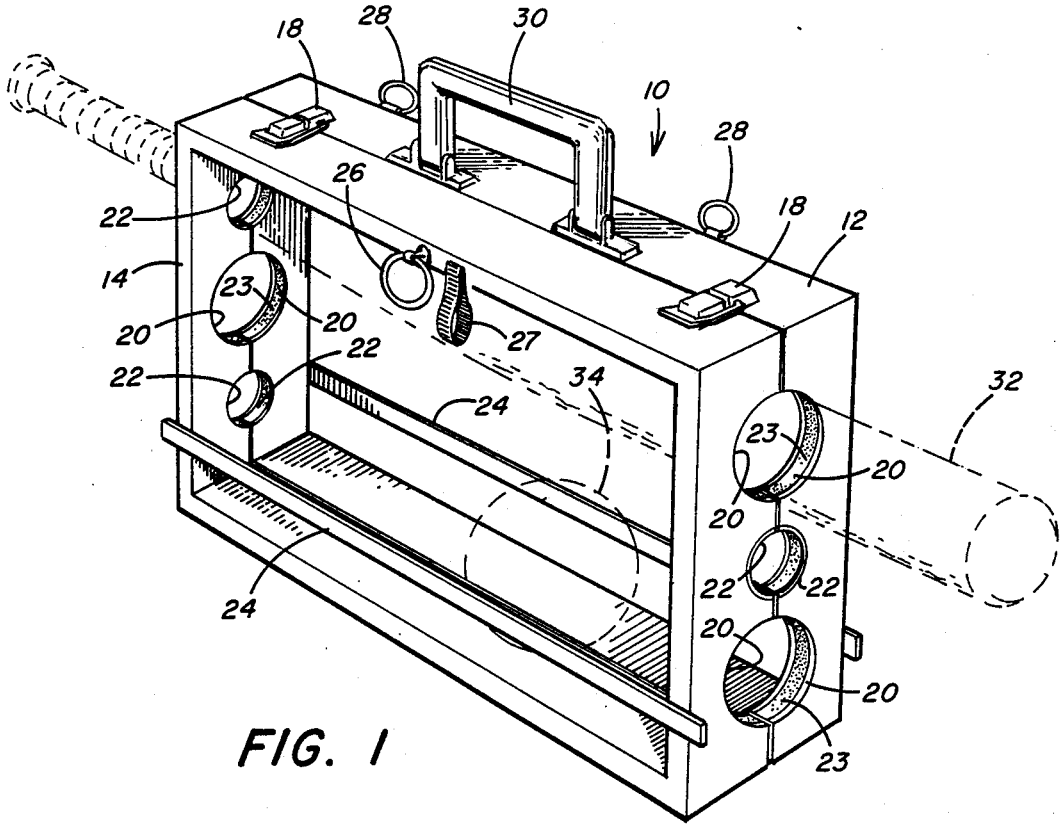
FIG. 1 is a perspective view of the personal sports equipment carrier of the present invention shown in the closed position as equipment will be transported therein.
Figure 2:
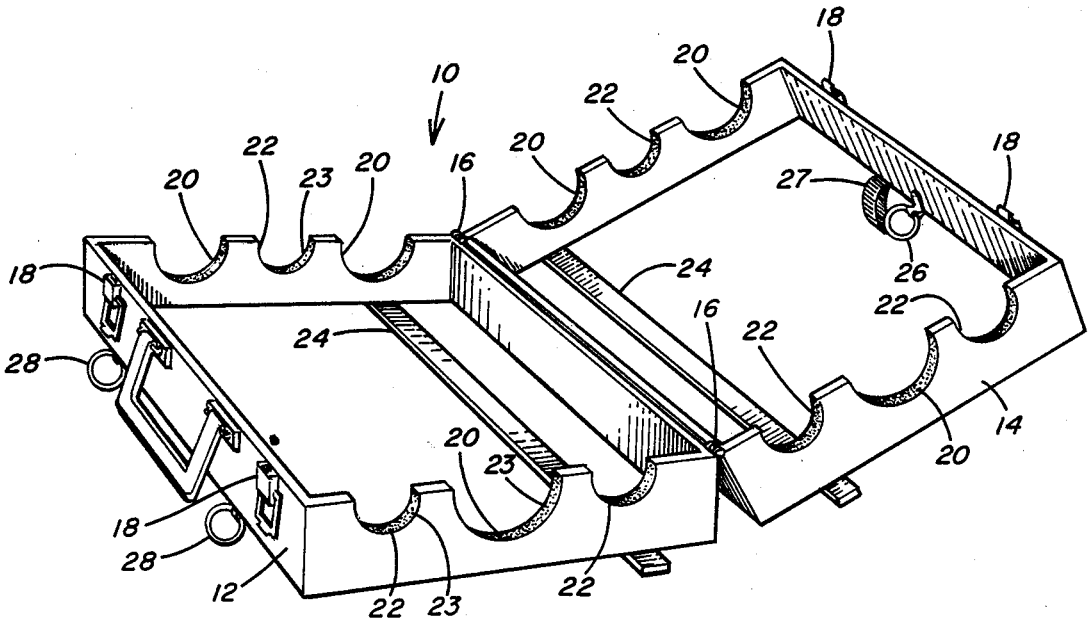
FIG. 2 is the personal sports equipment carrier of FIG. 1 shown in the open position for loading equipment into it or removing equipment from it.

Referring to the drawings, and particularly to FIGS. 1 and 2, there is illustrated a personal sports equipment carrier 10 having a first rectangular frame member 12 and a second rectangular frame member 14. The frame members 12 and 14 are connected by hinges 16 so that they may be pivoted relative to each other to the closed position as shown in FIG. 1 or to the open position as shown in FIG. 2.

Latches 18 are secured to the frame members 12 and 14 to latch the frame members in the closed position as shown in FIG. 1. The hinges 16 and latches 18 are of conventional construction and form no part of the present invention.

Formed in the frame members 12 and 14 are large semicircular recesses 20 and small semicircular recesses 22. When the frame members 12 and 14 are latched in the closed position shown in FIG. 1, the large semicircular recesses 20 register with each other to form complete circular recesses and the small semicircular recesses 22 register with each other to form complete circular recesses. Foam padding 23 is provided to line each of the semicircular recesses 20 and 22 to protect the bats that are carried by the recesses and to help grip the bats within the semicircular recesses 20 and 22.

Ball strips 24 are positioned longitudinally on the frame members 12 and 14 to retain balls within the frame member for transportation. The strips 24 are preferably located up from the bottom of the frame members 12 and 14 a distance approximately equal to the radius of the ball that will be retained in the frame member.

An eyelet 26 and a velcro strip 27 are fixed to the second frame member 14 to receive the strap of a baseball glove (not shown) and the shoe strings of the shoes (not shown) that are tied together so that the baseball glove and shoes may hang on the side of the frame member 14. It will be appreciated that either an eyelet 26 or a velcro strap 27 may be utilized alone or that both may be utilized as shown in FIGS. 1 and 2. Storage eyelets 28 are provided on the first frame member 12. The storage eyelets 28 will permit the personal sports equipment carrier 10 to hang on hooks or nails that may be provided to protrude from a wall so that the equipment carrier 10 and the equipment carried therein can be readily stored when the equipment is not in use.

The first frame member 12 has a handle 30 secured to it so that the sports equipment carrier 10 may be readily carried by the player owning the equipment. As shown in phantom in FIG. 1, a bat 32 and a ball 34 are positioned in the equipment carrier. It will be seen that large semicircular recesses 20 and small semicircular recesses 22 are alternated so that the bat is positioned with the heavy end of the bat in the large semicircular recess and the handle of the bat in the small semicircular recess which is axially aligned with the large recess. Below the handle of the bat 32 is a large recess and below the heavy end of the bat 32 is a small recess so that the adjacent bat would be positioned end to end relative to bat 32.

A third set of recesses 20 and 22 are shown adjacent the bottom of the frame as viewed in FIG. 1. If balls are to be carried in the frame member, there will be no room for the third bat. If a third bat is to be carried, the balls will be omitted from the frame.

It will be seen that the ball 34 is retained within the frame members 12 and 14 by strips 24. If desired, lightweight sides may be placed upon frame members 12 and 14 to provide an enclosed case similar to a small suitcase. In order to avoid the additional weight which must be carried along with the equipment, it is preferable to provide the strips 24 rather than full sides on the frame members.

Figure 3:
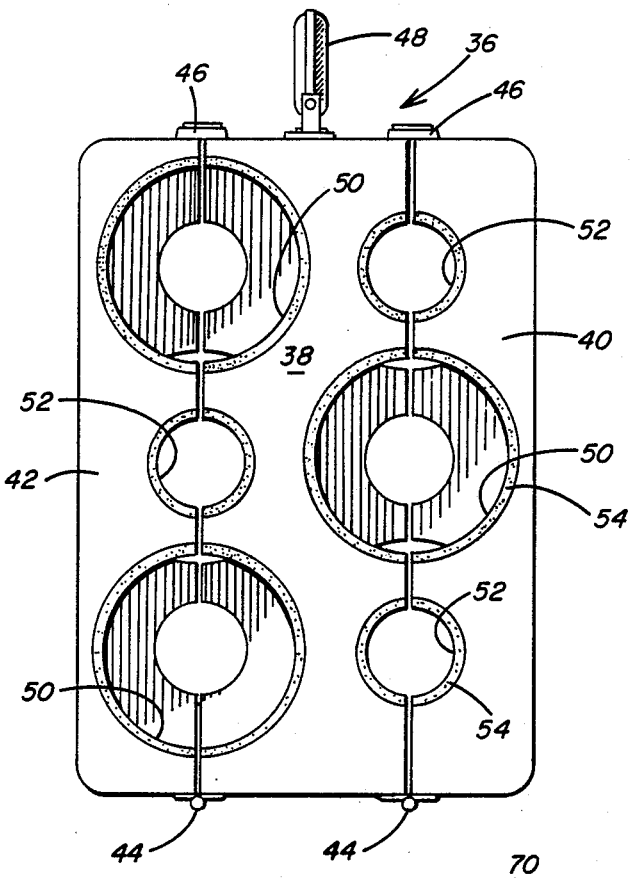
FIG. 3 is an end view of a personal sports equipment carrier similar to the carrier of FIGS. 1 and 2, but having increased capacity.

Referring to FIG. 3, there is shown a personal sports equipment carrier 36 which is generally similar to the equipment carrier shown in FIGS. 1 and 2. In the equipment carrier 36 of FIG. 3, an additional frame member is provided to increase the capacity of the carrier. The carrier 36 of FIG. 3 has a first frame member 38, a second frame member 40 and a third frame member 42. Hinges 44 are provided to pivotally secure the first frame member 38 to second frame member 40 and to third frame member 42. Latches 46 are provided to latch the second and third frame members to the first frame member 38 when the personal sports equipment carrier 36 is being carried.

A handle 48 is provided to carry the equipment carrier 36. The carrier 36 has large semicircular recesses 50 and small semicircular recesses 52 which each have foam padding 54 fixed to their edges.

As in the case of the carrier of FIGS. 1 and 2, the large semicircular recesses 50 and the small semicircular recesses 52 register with each other when the first frame member 38, the second frame member 40, and the third frame member 42 are moved to the closed position as shown in FIG. 3. The semicircular recesses 50 and 52 are alternated so that when bats are positioned within the recesses, adjacent bats are end to end with each other.

As in the case of the carrier 10 of FIGS. 1 and 2, strips such as strips 24 (FIG. 1) may be provided for the carrier 36 to retain balls in the bottom of the carrier 36. If balls are carried in the bottom of carrier 36, only four bats may be carried in the carrier rather than six bats which may be carried if no balls are provided in the bottom of the carrier. Eyelets similar to eyelet 26 and velcro strips similar to the strips 27 of FIG. 1 for carrying the glove and shoes; and eyelets similar to eyelets 28 of FIG. 1 for storing the carrier may be provided on personal sports equipment carrier 36 if desired.

Figure 4:
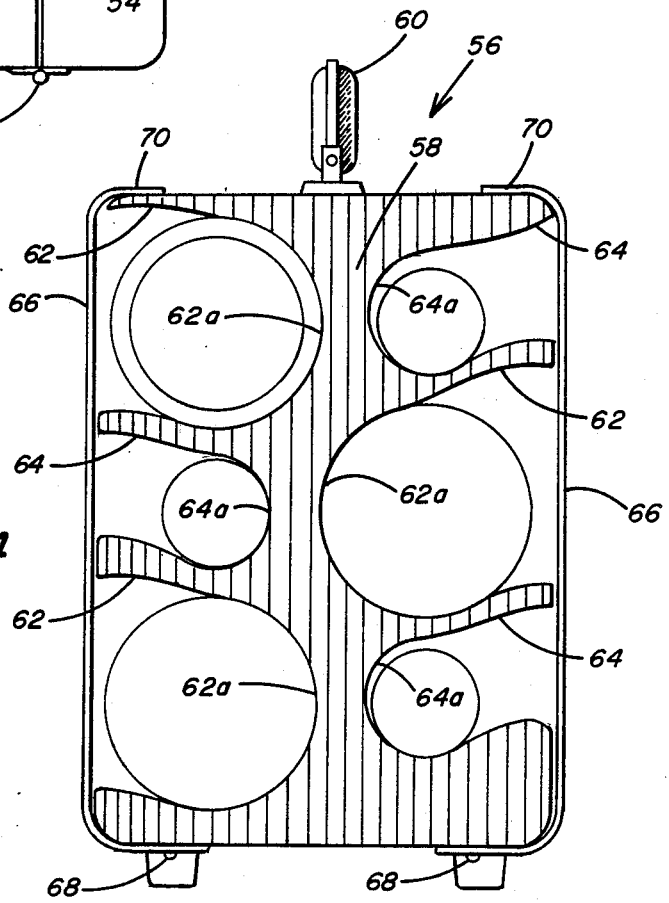
FIG. 4 is an end view of a personal sports equipment carrier that does not open and close as do the carriers of FIGS. 1–3.

Referring now to FIG. 4, there is shown a personal sports equipment carrier 56 which does not have hinged frame members such as are shown in FIGS. 1–3. In the carrier 56 of FIG. 4, bats are loaded into the side of the carrier and retained by straps. As shown in FIG. 4, the carrier 56 has end walls 58 and top and bottom walls (not shown) which connect the end walls. A handle 60 is attached to the top wall.

The end walls 58 have large recesses 62 that have circular end portions 62*a*. The end walls 58 also have small recesses 64 that have circular end portions 64*a*. As viewed in FIG. 4, bats are inserted into the end wall recesses 62 and 64 in end-to-end relationship. Straps 66 are fastened by fasteners 68 to the bottom wall of carrier 56. The straps 66 are connected by releasable connections 70 such as velcro ends or snaps to the top wall. The vertically extending straps 66 retain the bats in place within the personal sports equipment carrier 56.

If desired, strips similar to strips 24 of FIGS. 1 and 2 may be provided to retain balls within the personal sports equipment carrier 56. As in the carriers 10 and 36 of FIGS. 1–3, if balls are carried in the bottom of the equipment carrier, the lower spaces provided for the bats cannot be utilized. Eyelets similar to eyelet 26 and velcro strips similar to the strips 27 of FIG. 1 for carrying the glove and shoes; and eyelets similar to eyelets 28 of FIG. 1 for storing the carrier may be provided on personal sports equipment carrier 56 if desired.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A personal sports equipment carrier adapted for carrying baseball or softball equipment of an individual player comprising:

a rigid rectangular frame having recesses formed therein to receive one or more bats positioned longitudinally relative to said frame and extending beyond the ends thereof;

means to maintain said bats within said frame while transporting said frame and said bats;

glove and shoe retaining means attached to said frame for retaining a baseball or softball glove; said glove and shoe retaining means comprising an eyelet through which the strap on a glove and the laces of shoes may be passed;

means to retain one or more balls in the bottom of said frame while transporting said frame; and handle means attached to said frame to enable said player to carry said frame.

2. The personal sports equipment carrier of claim 1 having storage means secured to said frame for hanging said frame and equipment carried therein when not in use.

3. The sports equipment carrier of claim 1 wherein said recesses in said rigid rectangular frame are positioned to receive said bats in end-to-end relationship with the heavy end of one bat being in proximity to the handle of the adjacent bat positioned in said rectangular frame.

4. The personal sports equipment carrier of claim 2 wherein said storage means comprises one or more eyelets secured to said frame which may be positioned over hanging means protruding from a wall.

5. A personal sports equipment carrier adapted for carrying baseball or softball equipment of an individual player comprising:

a rigid rectangular frame having a first frame member and a second frame member;

hinge means connecting said first and second frame members whereby said frame members may be pivotally moved between open and closed positions relative to each other;

semicircular recesses formed in said first and second frame means so that when said first and second frame members are pivoted to the closed position, said semicircular recesses register with each other to form full circular openings in said frame, said full circular openings being of such size that a large circular opening in one end of said frame receives the heavy end of a bat and a small circular opening in the other end of said frame axially aligned with said large circular opening receives the handle end of the same bat;

latch means fixed to said first and second frame members for selectively latching said frame members in the closed position;

means to retain one or more balls in the bottom of said frame while transporting said frame; and handle means attached to said first frame member to enable said player to carry said frame and the sports equipment positioned therein.

6. The personal sports equipment carrier of claim 5 wherein said semicircular recesses have foam linings that secure and protect said bats within said recesses.

7. The personal sports equipment carrier of claim 5 wherein said means to retain one or more balls in the bottom of said frame comprises strips secured to the ends of said frame at a point above the bottom of said frame approximately equal to the radius of said ball.

8. The personal sports equipment carrier of claim 5 wherein a third frame member is hingedly secured to said first frame member on the side of said first frame member opposite from where said second frame member is hingedly secured thereto, said third frame member having semicircular recesses formed therein which register with similar semicircular recesses formed in said first frame member so that said personal sports equipment carrier can receive twice as many bats as can be received by the personal equipment carrier of claim 7.

9. The personal sports equipment carrier of claim 5 having means for holding a glove comprising an eyelet through which the strap on said glove may be passed.

10. The personal sports equipment carrier of claim 5 having means for holding a glove comprising a velcro strip which may receive the strap on said glove.

11. The personal sports equipment carrier of claim 5 having means to hang said frame comprising one or more eyelets secured to said frame which may be positioned over hanging means protruding from a wall.

12. A personal sports equipment carrier adapted for carrying baseball or softball equipment of an individual player comprising:

a rigid rectangular frame having a top, a bottom, a first end and a second end;

elongated recesses having circular end portions formed in said first and second ends of said frame, said recesses adapted to receive the heavy end of a bat in one end and the handle of a bat in the other end, said recesses being alternated so that adjacent bats are positioned end-to-end relative to each other;

strap means extending from said frame top to said frame bottom to hold said bats within said recesses;

means to retain one or more balls in the bottom of said frame while transporting said frame; and handle means attached to said frame top to enable said player to carry said frame.

13. The personal sports equipment carrier of claim 12 wherein said strap means comprises at least two straps detachable from said frame at one end of said straps.

14. The personal sports equipment carrier of claim 12 wherein said means to retain one or more balls in the bottom of said frame comprises strips secured to said frame first and second ends at a point above said frame bottom approximately equal to the radius of said ball.

15. The personal sports equipment carrier of claim 12 having means for holding a glove comprising an eyelet through which the strap on said glove may be passed.

16. The personal sports equipment carrier of claim 12 having means for holding a glove comprising a velcro strip which may receive the strap on said glove.

17. The personal sports equipment carrier of claim 12 having means to hang said frame comprising one or more eyelets secured to said frame which may be positioned over hanging means protruding from a wall.

* * * * *